United States Patent [19]

Williamson

[11] Patent Number: 4,833,437

[45] **Date of Patent: * May 23, 1989**

[54] MAGNETIC CORE INDUCTOR

[75] Inventor: James A. Williamson, Costa Mesa, Calif.

[73] Assignee: Williamson Windings Inc., Santa Ana, Calif.

[ * ] Notice: The portion of the term of this patent subsequent to Mar. 21, 2006 has been disclaimed.

[21] Appl. No.: 169,738

[22] Filed: Mar. 18, 1988

Related U.S. Application Data

[63] Continuation-in-part of Ser. No. 887,966, Jul. 21, 1986, abandoned, which is a continuation of Ser. No. 738,360, May 28, 1985, abandoned.

[51] Int. Cl.[4] ..... H01F 15/10; H01F 27/28

[52] U.S. Cl. ..... 336/192; 336/65; 336/83; 336/223; 336/229

[58] Field of Search ..... 336/223, 222, 192, 83, 336/212, 180, 181, 182, 183, 229, 186

[56] References Cited

U.S. PATENT DOCUMENTS

| | | | |
|---|---|---|---|
| 267,138 | 11/1882 | Blanchard | 336/223 X |
| 999,749 | 8/1911 | Chubb | 336/223 X |
| 1,801,214 | 4/1931 | Von Henki | 336/223 |
| 1,852,805 | 4/1932 | Frank | 336/223 |
| 2,061,388 | 11/1936 | Schou | 336/223 X |
| 2,568,169 | 9/1951 | Raczynski | 336/223 |
| 2,972,713 | 2/1961 | Sutton, Jr. | 336/221 X |
| 3,271,716 | 9/1966 | Furth | 336/223 X |
| 3,771,086 | 11/1973 | Poolsen | 336/223 |
| 3,832,661 | 8/1974 | Sato | 336/223 |
| 4,188,599 | 2/1980 | Papa | 336/223 X |
| 4,362,990 | 12/1982 | Schneider et al. | 336/212 X |
| 4,507,640 | 3/1985 | Rich, III et al. | 336/83 X |

FOREIGN PATENT DOCUMENTS

| | | | |
|---|---|---|---|
| 1308052 | 9/1961 | France | 336/223 |
| 1578613 | 7/1969 | France | 336/223 |
| 400275 | 11/1942 | Italy | 336/223 |
| 488264 | 5/1970 | Switzerland | 336/223 |
| 581514 | 11/1977 | U.S.S.R. | 336/223 |
| 29274 | of 1915 | United Kingdom | 336/223 |
| 677918 | 8/1952 | United Kingdom | 336/223 |

*Primary Examiner*—Thomas J. Kozma

*Attorney, Agent, or Firm*—Wilfred G. Caldwell; James F. Kirk

[57] ABSTRACT

A winding for a magnetic core is preformed as a flat conducting strip disposed in a helical coil configuration of circular shape, having elongated integral tabs at selectible angles to the coil from substantially tangential to substantially radial orientation for cooperation with the magnetic core exit slots, thereby maximizing core window utilization and adapting to conventional cores. The cross sectional area of the tabs is less than the cross sectional area of helix turns thereby further eliminating interference with smaller core exit slots.

3 Claims, 6 Drawing Sheets

FIG. 9A
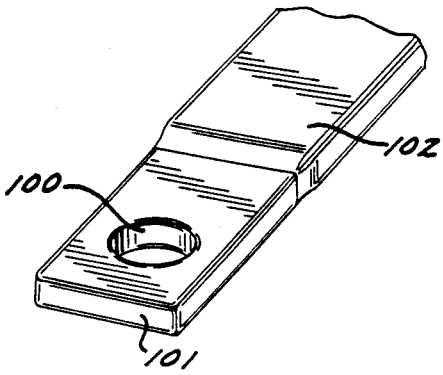
FIG. 9B
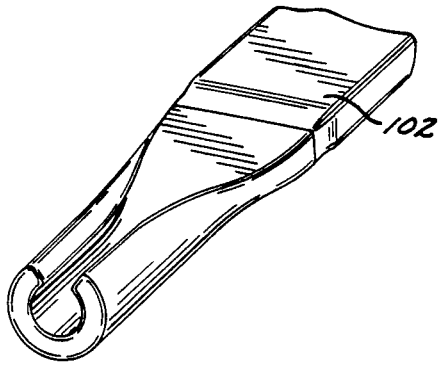
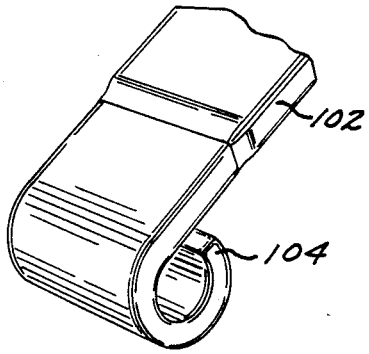
FIG. 9C
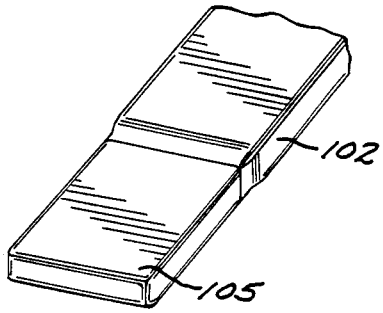
FIG. 9D
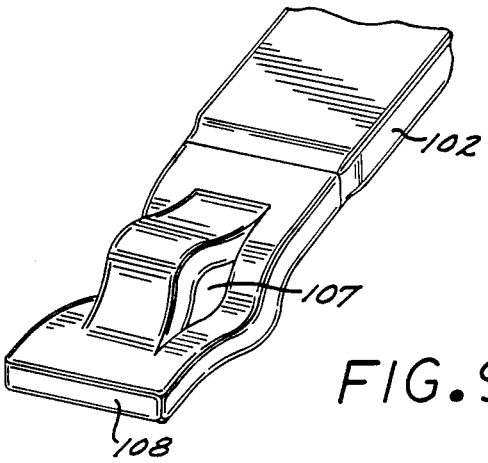
FIG. 9E

MAGNETIC CORE INDUCTOR

This is a continuation-in-part of copending continuation application Ser. No. 887,966 filed on July 21, 1986, now abandoned. application Ser. No. 887,966 was a copending continuation application of parent application Ser. No. 738,360, filed May 28, 1985, now abandoned.

FIELD OF THE INVENTION

The inductor comprises a helix ribbon type flat conductor conformable to conventional cores for maximum efficiency using integral tabs adapted for core exit to establish electrical connections in any number of configurations.

BACKGROUND OF INVENTION

Magnetic coils are employed in a wide variety of different applications, such as transformers, electric motors, relays and as inductive impedances. Such coils are currently manufactured in two ways. The first and most common method of coil manufacture is the wrapping of circular copper wire on a bobbin which is then placed on a magnetic core. The other method that is sometimes used is the wrapping of a rectangular copper strip on a bobbin as a spiral wound coil which is then placed on a magnetic core.

Coils formed by the first method are quite readily fabricated but have numerous disadvantages which are overcome by strip wound coils. Thus, because the rectangular strip fits better or tighter on a bobbin, a larger amount of conductor may be wound on a bobbin and internal losses are reduced. Strip wound coils are easier to tap and have better thermal heat conductivity, as well as a lesser danger of arcing because consecutive turns lay next to each other rather than being displaced so that no large voltage exists between turns.

Both wire wound and strip wound coils require bobbins which are advantageous both in coil winding and in coil use, and neither readily admits of any modification once a coil is completed.

SUMMARY OF INVENTION

The present invention comprises a novel preformed magnetic coil helix winding adapted to be placed upon a conventional magnetic core for improved performance characteristics. The coil hereof is formed of a material having good electrical conductivity, such as copper, with the conductor having a rectangular cross section, and elongated integral tabs. The conductor is preformed into a helical coil configuration which may be circular, square, or rectangular, depending upon the shape of the core upon which it is adapted to fit.

By preforming the coil winding of the present invention, it is possible to shape and complete the coil separately from any support structure, so that coil characteristics are exactly predeterminable and also windings may be readily interchanged on a core. No bobbin or the like is required with the present invention so that the entire winding volume may be employed for conductor instead of some being taken up by a bobbin. Windings of the present invention are designed for optimum operation for the intended application.

The integral tabs may comprise partial or full unwound elongated turns of the coil with the cross section thereof being less than the cross section of a remaining coil turn, which construction admits of continuous production rather than single coil production, as well as automatic processing or assembly due to stacking and dispensing. The integral tabs are indented and inwardly offset relative to the coil to accommodate core window edges thereby enhancing winding efficiency on the core while enabling parallel tab leads from the same side of the coil to fit printed circuit board rceiving slots, avoid shorting and provide esthetic appeal. The metal of the coil turns (e.g. copper) is annealed to establish malleability thereof which, among other features, permits the helix to be elongated to receive a toroidal core, if desired.

Thus, the present invention comprises a helix-wound coil inductor which has all of the advantages of a strip wound coil, and additional advantages, as noted below.

1. Integral tabs requiring no soldering, welding or other joints, of the same material and coefficients as the coil turns.

2. The coil and integral tabs having configurations to accommodate window edges, while maximizing coil metal on the core, and providing parallel tabs extending from the same side of the coil for printed circuit plug-in or other uses.

3. The so-configured coil and tabs being capable of efficiently fitting conventional magnetic cores to enhance performance and facilitate automatic production techniques.

4. Partial or full turns may be unwound to comprise the tabs in positions to flexibly accommodate various exit window configurations.

5. The coil is characterized by malleability to accommodate toroidal cores.

6. A device of improved performance characteristics which is easier to fabricate, delivers a connection tab of any desired length, and conserves space.

7. The malleable elongate tabs permit termination of the tab in various connector configurations.

DESCRIPTION OF FIGURES

The present invention is illustrated as to particular preferred embodiments thereof in the accompanying drawings wherein.

DESCRIPTION OF PREFERRED EMBODIMENTS

Figure 3:
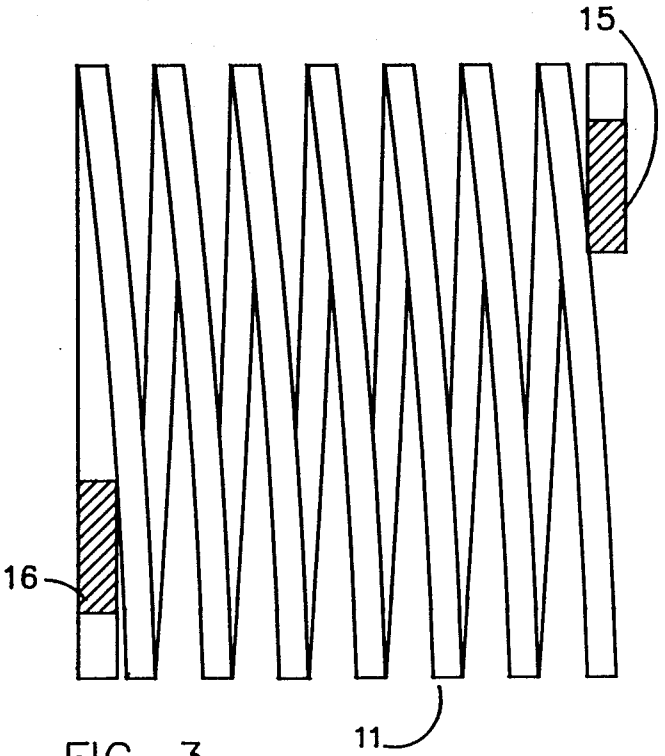
FIG. 3 is a side elevational view of an expanded helical winding with integral tabs in accordance with the present invention.
Figure 2:
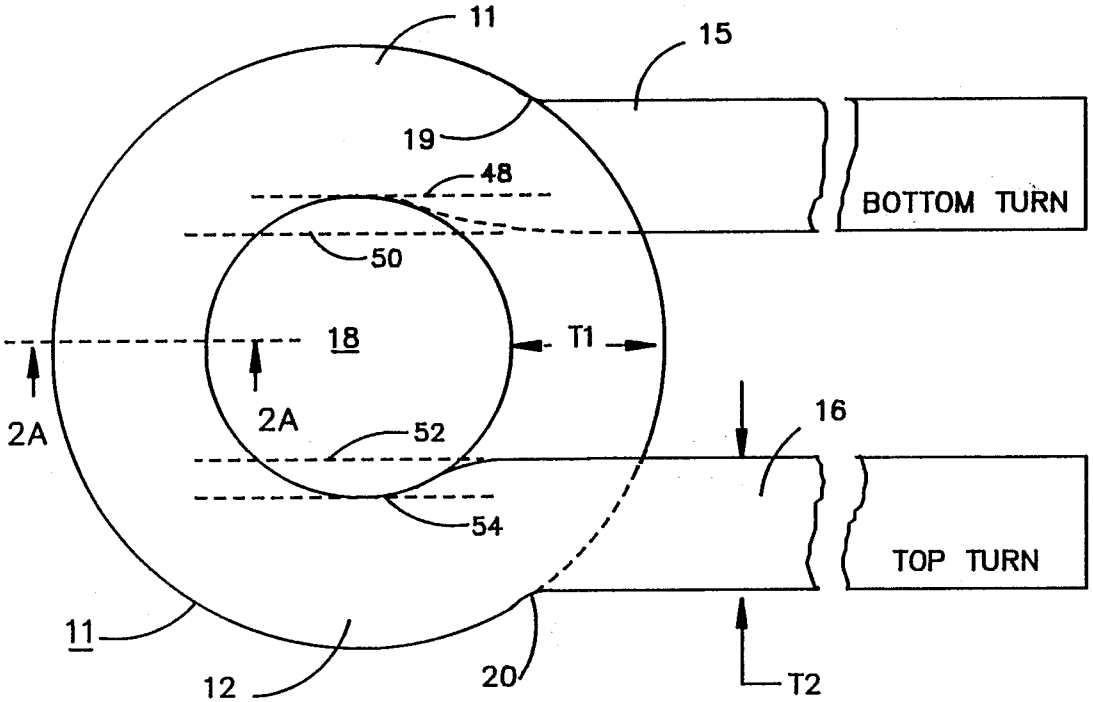
FIG. 2 is a top elevational view of a helical winding with integral tabs, in acccordance with the present invention.
Figure 2A:
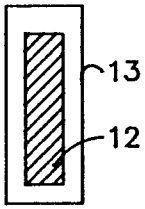
FIG. 2A is a sectional view of an insulated coil turn.

Preferred embodiments and applications of the present invention are illustrated in the drawings, and referring first to FIG. 2 thereof, there is shown a preformed helical winding, all in accordance with the present invention. This winding 11 is formed of a conductor 12 having a rectangular cross section and coated or otherwise enclosed by an insulating envelope 13, as indicated in FIG. 2A. The conductor 12 of the winding is formed of a metal having good electrical conducting properties, such as copper or aluminum, and is reformed in the circular helical configuration best seen in FIG. 3.

Figure 5:
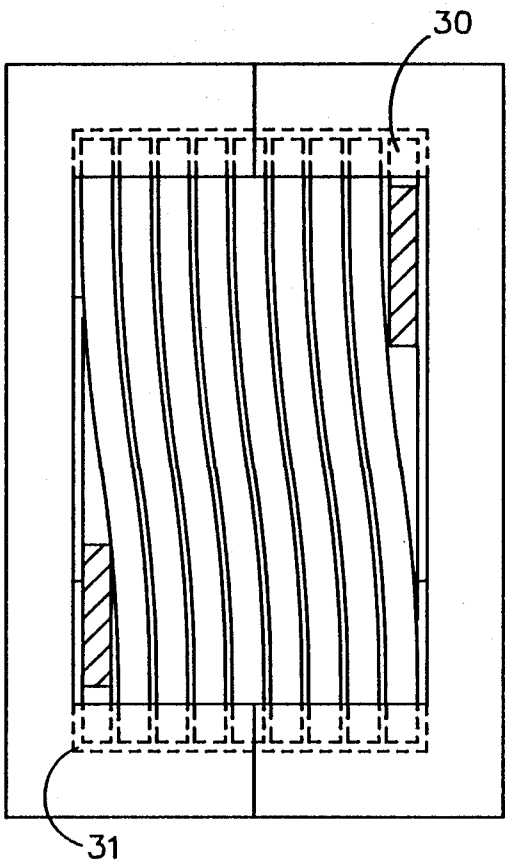
FIG. 5 is a side elevational view of the structure showing a compressed coil.
Figure 4:
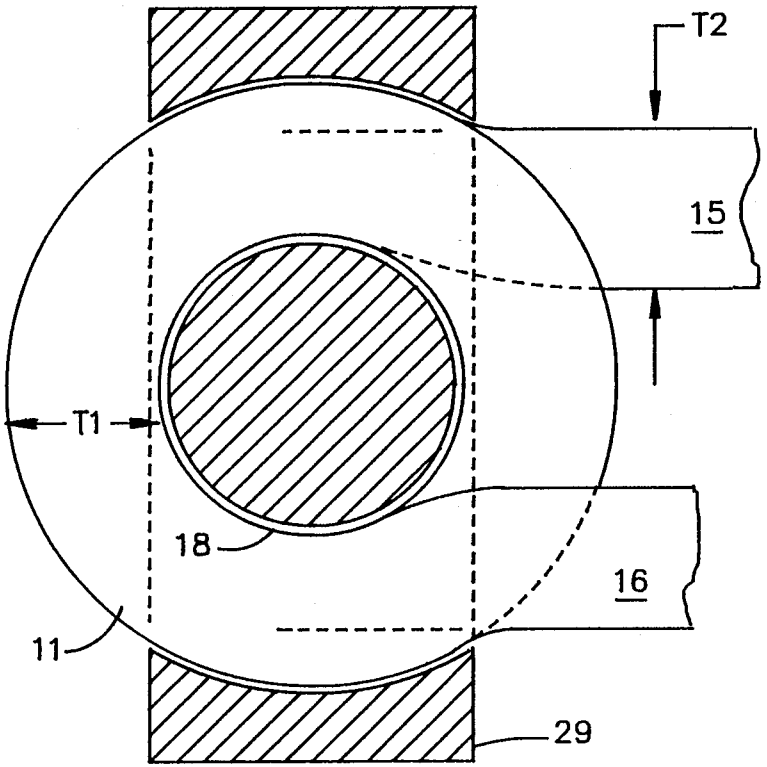
FIG. 4 is a top plan view of the coil mounted on a magnetic core.
Figure 6:
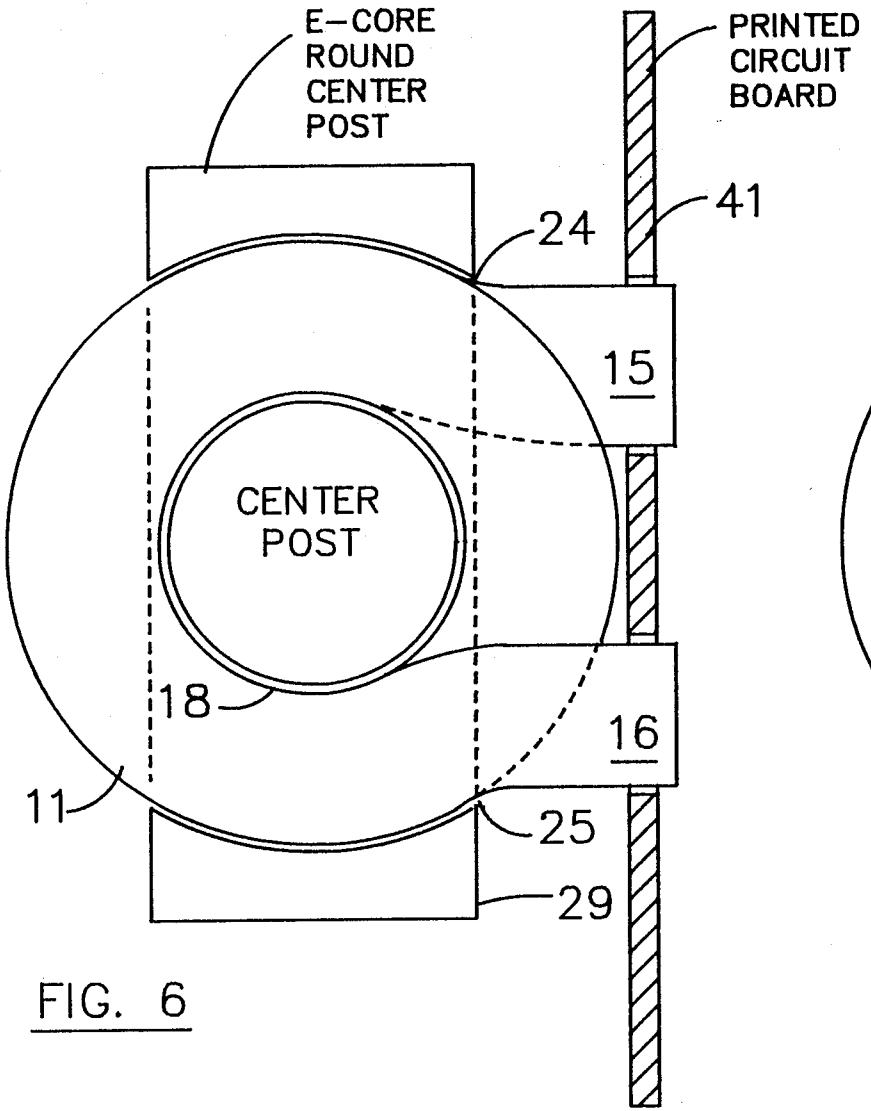
FIG. 6 shows the structures of FIGS. 4 and 5 relative to a board.

FIG. 2 also shows the integral tabs 15 and 16 with cross sectional areas T2, less than the cross sectional area T1, of any turn. The apparent indentations or generally inwardly extending arcuate regions 19, 20 account for the offsets of the tabs from tangents to the central opening 18, such that the arcuate regions 19, 20 may accommodate the vertical edges 24, 25 (FIG. 6) of the core outer leg arcuate portions 30, 31 (FIG. 5). This permits a snug fit (although the spacings are shown exagerated for clarity) between the coil periphery and the outer leg portions 30, 31, thereby improving magnetic efficiency. The arrangement also enables the coil integral tabs 15, 16 to extend exteriorly from the device, in parallel relation, for slot connection to board 41, shown dotted-in (FIG. 6). The offset direction of the tabs if extended inwardly as characterized by phantom lines 50, 52 from tangents to the central opening 18 characterized as phantom lines 48, 54 in the direction of the coil central opening define chords of the coil central opening 18 rather than tangents.

Figure 1:
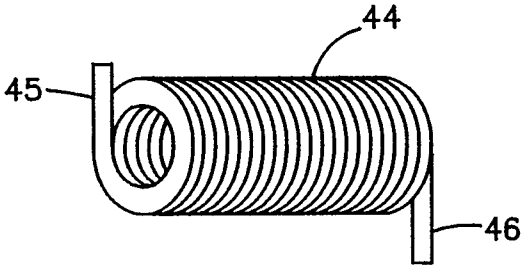
FIG. 1 PRIOR ART
FIG. 1 is a perspective view of a PRIOR ART helical coil.

A comparison to the PRIOR ART showing of FIG. 1 reveals a helix coil 44 having tabs 45, 46. This is an air core coil which doesn't resolve the magnetic core-type problems, i.e., substantially completely filling the window volume of the magnetic core while offsetting the tabs to accommodate core edges enabling parallel tabs for electrical connections and access space and without causing shorts.

From the figure, taken from U.S. Pat. No. 999,749 to L.W. Chubb, issued Aug. 8, 1911 (FIG. 1 herein), it may be seen that the tabs are the same dimensions as the winding turns—no reduced tab cross section nor indented or inwardly arcuate regions being disclosed. Consequently, the tabs are confined to a tangential direction and may not be selectively oriented throughout the range from tangential to substantially radially, relative to the core opening, as available from the present invention.

In the present invention, this range is available because the integral tab is forced into a hardened guide-slot as it is unwound from the coil and the height of the guide slot relative to the gripped coil determines the offset with the amount of turn(s) unwound determining the tab length.

The winding of the present invention has a predetermined conductor size and the complete winding for any particular application is formed prior to application to or in cooperation with any type of core structure, so that characteristics, such as winding efficiency and the like may be determined prior to completion of a magnetic coil. The winding thereof is adapted to be placed upon a magnetic core after completion of the winding which may, of course, be tested and checked prior to incorporation with other elements. The PRIOR ART, being confined to an air core, has not faced these many problems.

Figure 7:
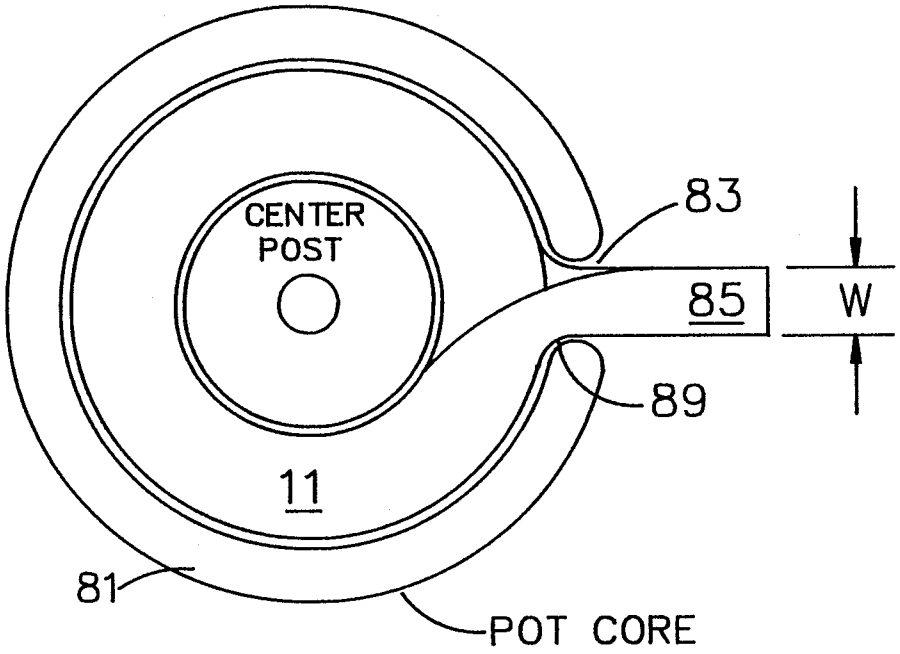
FIG. 7 is a ferrite pot core lower half with a helix coil and integral tab exiting via the core slot.

In FIG. 7, the lower half of a ferrite pot core is shown at 81, together with helix coil 11. Note the small width slot 83 left in this conventional core for exit of the integral tab 85. Here, the reduced width "W" of tab 85 enables the necessary exit while the turn width may be substantially wider for efficiency. The "W" dimension is foreshortened by applying heavy pressure to the upper edge of the tab as it is being uncoiled to elongate the same while narrowing its width, which avoids rippling and tearing of the tab. The cross sectional area of the tab is reduced at least 10%, and much more where desired, as in this particular application. The tab preferably is and has always been an "unwound elongated integral tab" where the words "unwound", "elongated" and "integral" are used as adjectives to explain and describe the distinctive and unique features of the the tabs as characterized herein and above and in the accompanying drawings.

Also, in FIG. 7, the sharp curvature in the inner mouth of the slot 83, due to the shape of the outer core leg requires a significant inwardly directed arcuate region 89 in tab 85, uniquely achievable by this invention. If the top half of coil 11 were present, it would be seen that the upper tab would exit the same size slot either aligned with or non-aligned with slot 83, but from the opposite direction.

It may now be appreciated that the prior art coil 44 of FIG. 1 simply could not be adapted to the conventional core 81 of FIG. 7 because the width of its tabs 45 and 46 are exactly the same as the width of its turns. Thus, if small enough leads are employed for exit slot 83, the amount of copper or metal on the core will be atrociously small and efficiency and performance is lost. The present invention, through its provisions of the offset 89 and reduced tab 85 cross sectional area (either by lesser tab width or height), enhances the metal efficiency greatly to make the inductor a most desirable product. The subject invention, with a directional range of substantially tangential to substantially radial for the tabs relative to the coil opening, permits use with these tiny exit core slots because the tabs may navigate sharp curvatures.

Figure 8:
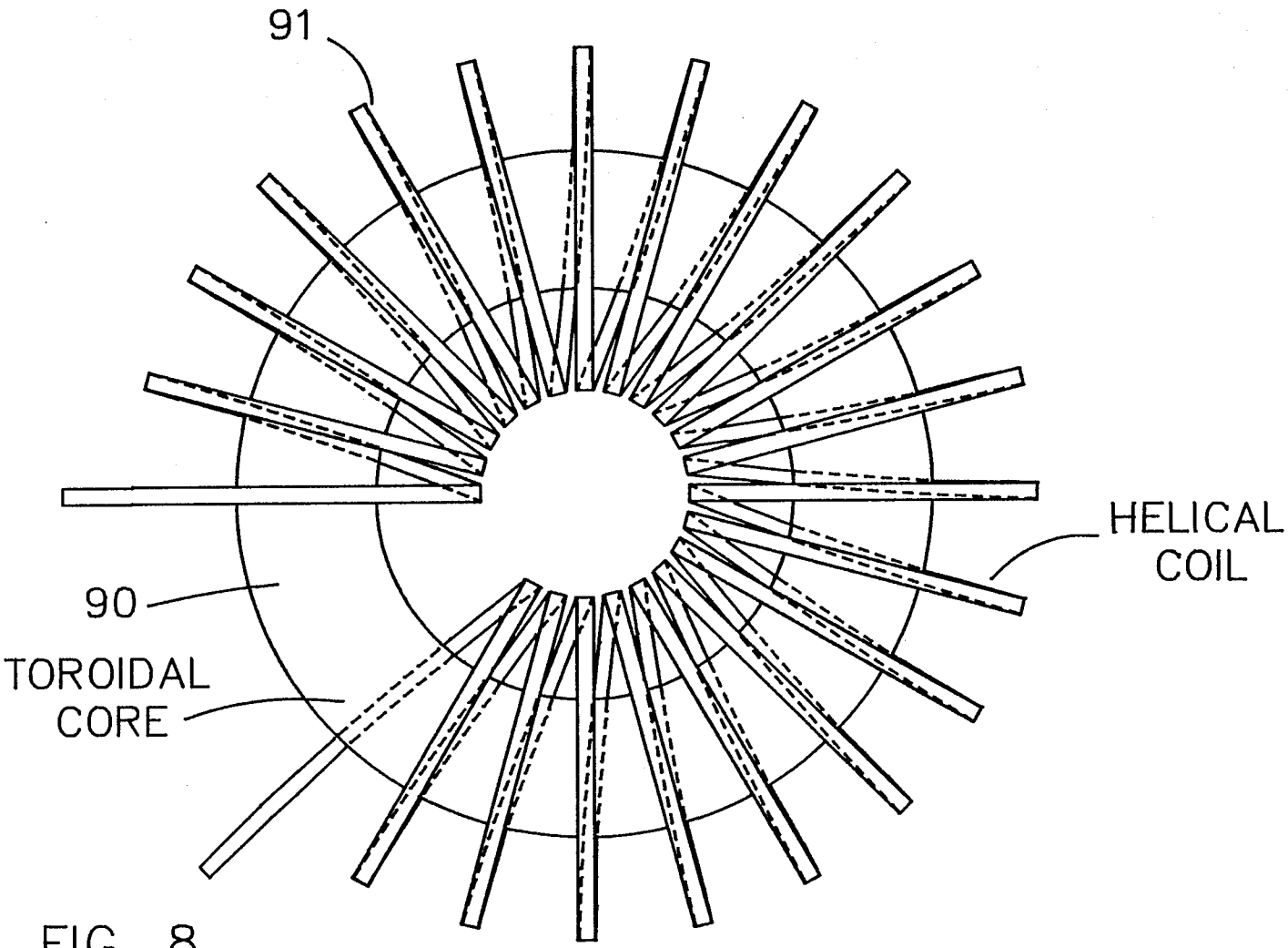
FIG. 8 is a toroidal core with helix being spiralled thereon, and, FIGS. 9A–9E show some of the configurations available to serve as tab termial connections.

FIG. 8 shows a toroidal core 90 with a helical coil 91, in accordance with the present invention, being positioned thereon. Since the metal (e.g. copper) of the helix is malleable following annealing, the turns are separated sufficiently to permit the core to be received in the central opening of the winding 91.

Many advantages of the invention should now be apparent. Additionally, the thermal conductivity is maximized for the evacuation of heat generated in the turns of the windings, particularly, with respect to wire wound coils which have low thermal conductivity in all but the outside turns thereof. It is additionally noted that, as compared to the wire wound coils, the present invention provides adjacent turns of the coil next to each other, so that the voltage between adjacent conductors can be no greater than the voltage generated about a single turn, so as to reduce the possibility of arcing between turns, as well as reducing the amount of charge required to change the voltage on interturn capacitance because of lower voltage swing.

A further, and major advantage, of the present invention is found in the maximization of the amount of conductor that can be placed in any given core or volume, because no bobbin or the like is required in the present invention. At least certain of the foregoing advantages of the present invention are also available with strip wound coils; however, the latter require the inclusion of a bobbin during formation and subsequent use and are not premade or preformed, but instead, are only incorporated as an element in a complete unit including a bobbin upon which the strips are wound.

The electrical winding structure of the present invention is designed for optimum operation, and thus, for example, the primary winding of a transformer is made to fill half the winding window and the other half left for the secondary without regard to the number of turns in each winding or the turns ratio. In addition, the present invention is highly advantageous over prior winding structures from the view point of flexibility. As an example, it is only possible to change the number of turns in a strip wound or wire wound transformer by completely redesigning the transformer and making a new one. On the other hand, a helix wound transformer, in accordance with the present invention, provides the capability of removing the windings and replacing them with new windings having an appropriate number of turns. A further advantage is found in the fact that the windings that have been removed may be re-used.

For square or rectangular coils (not shown), the curved portions of the coils are simply relieved.

To make the inductor of this invention, it is first necessary to form the proper size helical coil.

For forming the helical coils see:

U.S. Pat. No. 368,569 to O. Caldwell Aug. 23, 1887 German AUSLEGESCHRIFT No. 1,177,595 Sept. 10, 1964 German PATENTSCHRIFT No. 562621 Oct. 27, 1932

Next, the coils are annealed in a controlled atmosphere to avoid oxidation, and induce malleability.

Next, the tabbing step, as outlined, supra is performed, followed by applying an insulating coating, such as epoxy.

The coated coil is then ready for installation in the selected magnetic core.

The integral tabs may be directly terminated in connections, other than for board plug-in without resort to any joints, soldering or welding. In FIG. 9A, a hole 100 is drilled in a tab 101 adjacent the free end which is free of insulation 102.

In FIG. 9B, the insulation free tab end is rolled longitudinally.

FIG. 9C shows the end 104 coiled laterally. FIG. 9D shows an insulation free rectangular shaped end 105.

FIG. 9E shows an elongated opening 107 in free end 108 which is like a split to admit a connection.

Thus, the elongated integral tabs are useful for many other applications, including bending in any type configuration chosen, at adjacent or remote locations, particularly important to custom jobs. The integral tabs may have lengths of 6 to 12 inches, more or less.

A further feature of the invention comprises a helix coil wherein the turns are subjected to axial compression to the extent that n turns has a height corresponding to n+1 turns due to the fact that the end turn terminal portions are disposed in the top and bottom of the stacked turns oppositely of each other relative to the coil, whereby at least one terminal turn is absorbed into the stacked height because the other intermediate turns are non-flat (wavy) to absorb such compression. Such a configuration is illustrated in FIG. 5, thereby substantially increasing the coil metal per given window size. Up to 5 tons or more of force is used to compress the coils, depending upon the coil turn thickness, diameter and conductor width.

Figure 10:
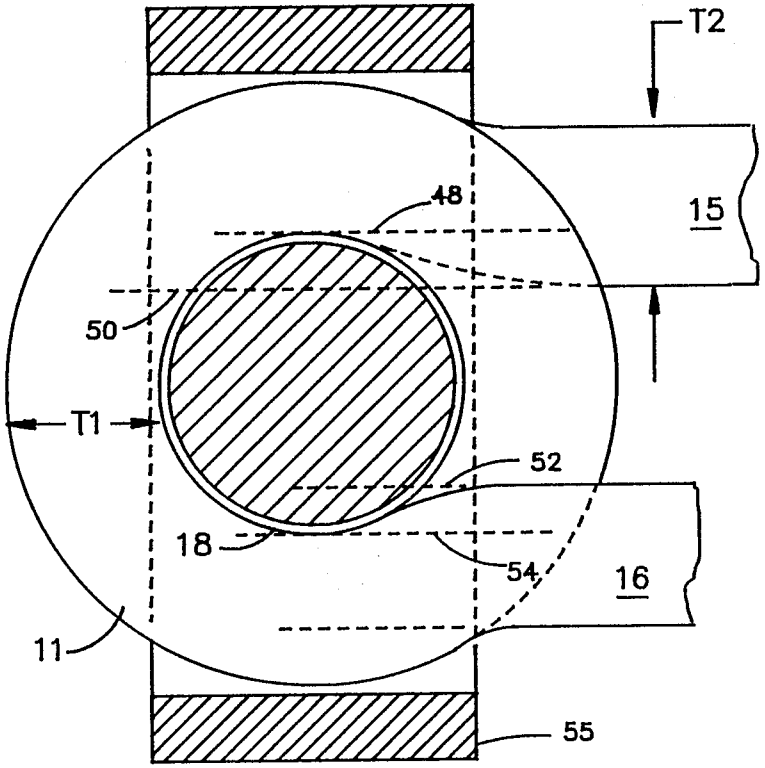
FIG. 10 is a top plan view of the coil mounted on the bottom half of a magnetic core having outer posts of rectangular cross section.

FIG. 10 shows a core having a circular center post and side posts 55 having a rectangular cross-section. Each side post is designed to have a side post cross-sectional area equal to at least one half of the area of the center post.

Figure 11:
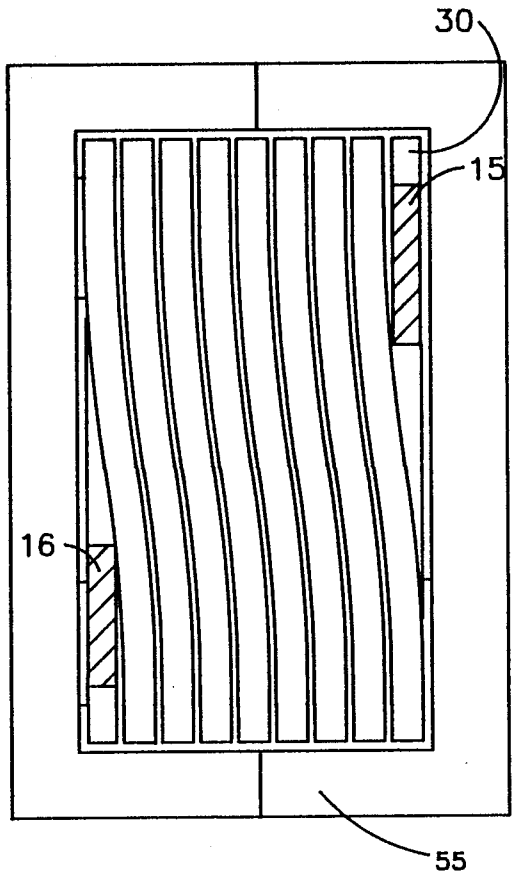
FIG. 11 is a side elevational view of the structure of FIG. 10 with the top half and bottom half of the core mounted on the coil and showing a compressed coil.

FIG. 11 shows the compressed coil 16 with the side view of the side posts 55 of the core. No hidden region such as region 31 of FIG. 5 exist.

I claim:

1. A magnetic core inductor comprising in combination:

a core comprising a substantially closed magnetic path about a core window;

a continuous, monolithic helix coil of insulated flat metal ribbon having a width greater than the thickness and forming at least two insulated stacked turns having a first integral end, a second integral end and a central opening; said central opening of said coil being provided to receive a central leg of said magnetic core, each of said first and second integral ends comprising respective elongated integral tabs, each said turn being uniformly coated with an insulating envelope to comprise said insulated turns;

said core having at least two outer legs, each outer leg having an inner portion thereof bordered by vertical edges, said inner portions facing said central leg in opposing relation to receive the outer perimeter of said helix coil, said opposing vertical edges forming the side borders of the core window through which said elongated integral tabs exit said core and said coil normal to the plane of said window, said elongated tabs being parallel and offset inwardly from a direction tangential to said coil central opening;

each end of said coil comprising an unwound elongated integral tab exiting said helix coil in said direction offset inwardly from said direction tangential to said central opening;

the offset position of the tabs locates the inner edges of said elongated tabs, which edges, if extended, in the direction of said coil central opening define chords of the coil central opening rather than tangents to said central opening each of said elongated tabs has a deceased width and cross sectional area relative to the width and cross sectional area of the turns, and, said helix coil being compact, comprising n+1 turns but characterized by a height substantially equal to the height of a similar uncompacted coil of n turns.

2. The magnetic core inductor of claim 1 wherein each of said inner portions of said outer leg is characterized by a concentric surface relative to said central opening of said coil.

3. The magnetic core inductor of claim 1 wherein each of said outer legs is characterized by a rectangular cross section.

* * * * *